US007997865B1

(12) United States Patent
Liang

(10) Patent No.: US 7,997,865 B1
(45) Date of Patent: Aug. 16, 2011

(54) TURBINE BLADE WITH TIP RAIL COOLING AND SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 576 days.

(21) Appl. No.: 12/212,890

(22) Filed: Sep. 18, 2008

(51) Int. Cl.
*F01D 5/18* (2006.01)

(52) U.S. Cl. ..... 416/92; 416/96 R

(58) Field of Classification Search ..... 416/92, 416/96 R, 97 R, 228; 415/173.1
See application file for complete search history.

(56) References Cited

U.S. PATENT DOCUMENTS 5,192,192 A * 3/1993 Ourhaan ..... 416/97 R
5,403,158 A * 4/1995 Auxier ..... 416/97 R
2004/0096328 A1 * 5/2004 Soechting et al. ..... 416/92
* cited by examiner

*Primary Examiner* — Kiesha Bryant
*Assistant Examiner* — Ali Naraghi
(74) *Attorney, Agent, or Firm* — John Ryznic

(57) ABSTRACT

A turbine blade with a squealer pocket formed from a pressure side tip and a suction side tip rail, where two vortex cooling channels extend along the blade tip between the tip rails and an internal cooling air supply cavity to provide vortex cooling for the tip rails. Curved cooling air passages connect the cooling air supply cavity to the vortex channels and then discharge cooling air onto the pressure side wall just below the tip rail crown and into the squealer pocket from the inner surface of the suction side tip rail. Tip cooling holes are also connected to the cooling air supply cavity and discharge cooling air against the inner sides of the two tip rails to promote a vortex flow within the squealer pocket. The curved cooling holes in the vortex cooling channels are offset in order to promote the vortex flow within.

7 Claims, 4 Drawing Sheets

TURBINE BLADE WITH TIP RAIL COOLING AND SEALING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbine blade, and more specifically to a turbine blade with tip cooling and sealing.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the pressure side and FIG. 3 shows the suction side each with tip peripheral cooling holes for the prior art turbine blade of FIG. 1.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited. In addition, a TBC is normally used in the industrial gas turbine (IGT) airfoil for the reduction of blade metal temperature. However, to apply the TBC around the blade tip rail without effective backside convection cooling may not reduce the blade tip rail metal temperature.

FIG. 4 shows a prior art turbine blade with a tip rail cooling design. A pressure side film cooling hole located on the pressure side wall of the blade and below the pressure side tip rail discharges a film layer of cooling air slightly upward and out onto the surface of the pressure side wall to flow over the pressure side tip rail. A similar suction side film cooling hole is located on the suction side wall. Two tip convective cooling holes discharge cooling air into the squealer pocket and produce a vortex flow of the cooling air as represented by the swirling arrows. These two holes are located adjacent to the inner sides of the tip rails. In the FIG. 4 tip rail design of the prior art, the vortex flow develops on the inner sides of both tip rails and travels along the inner side from the leading edge to the trailing edge of the tip pocket.

This problem associated with turbine airfoil tip edge cooling and sealing can be minimized by incorporation of a new and effective vortex cooling channel with discrete curved cooling holes into the prior art airfoil tip section cooling design.

BRIEF SUMMARY OF THE INVENTION

It is an object of the present invention to provide for a turbine blade with an improved tip cooling and sealing than the prior art blade tips.

It is another object of the present invention to provide for a turbine blade with less leakage across the tip gap than in the prior art blade tips.

It is another object of the present invention to provide for a turbine blade with a greatly reduced airfoil tip metal temperature so reduce the required amount of cooling flow.

The turbine blade includes a tip rail with a pressure side tip rail and a suction side tip rail that forms a squealer pocket, the tip rails include a vortex cooling channel in each that extends along the tip rail from the leading edge to the trailing edge, a curved cooling hole connecting the cooling supply cavity of the blade to the pressure side wall just below the tip rail, a curved cooling hole connecting the cooling supply cavity to the suction side tip rail on the squealer pocket side of the tip rail, a curved cooling hole to discharge cooling air onto the inner surface of the pressure side tip rail, and another curved cooling hole to discharge cooling air onto the inner surface of the suction side tip rail, where the vortex chambers provide a vortex flow of the cooling air to enhance the heat transfer coefficient, the pressure side wall cooling holes force the hot gas flow up and over the pressure side tip rail to form a reduced size vena contractor area with the blade outer air seal (BOAS), and the curved cooling holes on the inside of the squealer pocket produce a vortex flow of the cooling air on the inner sides of the two tip rails to provide increased cooling effectiveness and reduced leakage flow across the tip rails.

In this particular tip rail cooling and sealing design, a continuous vortex cooling channel with discrete curved holes are constructed all around the airfoil peripheral at the airfoil and squealer floor intersection. Discrete cooling holes can be drilled on top of the blade tip as well as within the squealer pocket from the airfoil leading edge to the trailing edge. These discrete curved cooling holes are at a staggered array formation along the blade pressure and suction side peripheral walls.

DETAILED DESCRIPTION OF THE INVENTION

Figure 1:
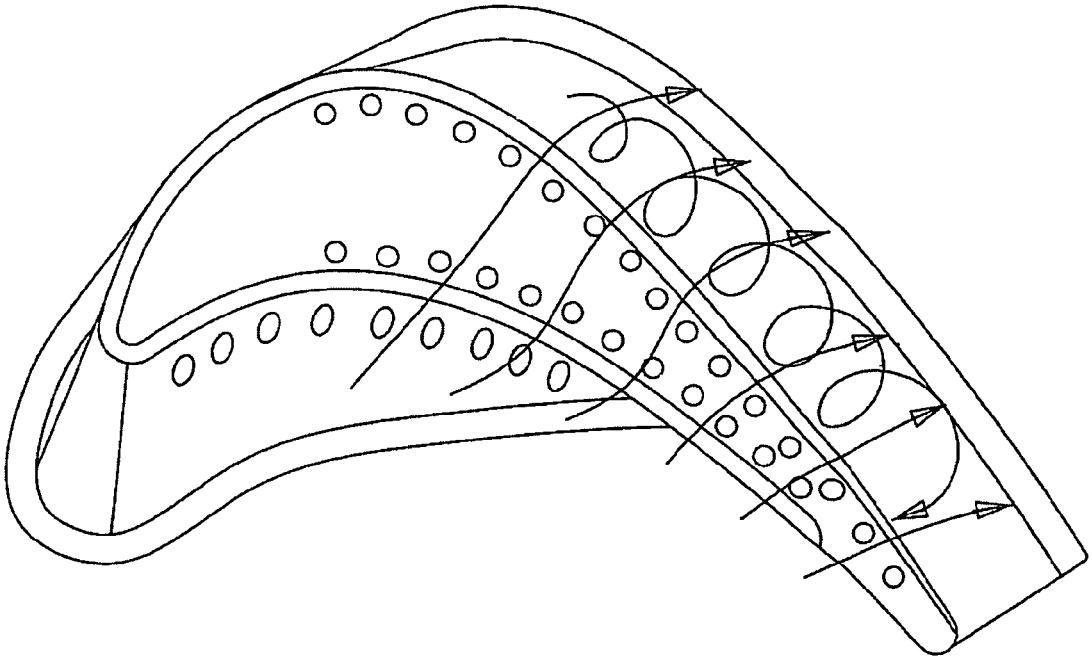
Fig 1 Prior Art
FIG. 1 shows the prior art squealer tip cooling arrangement and the secondary hot gas flow migration around the blade tip section.
Figure 2:
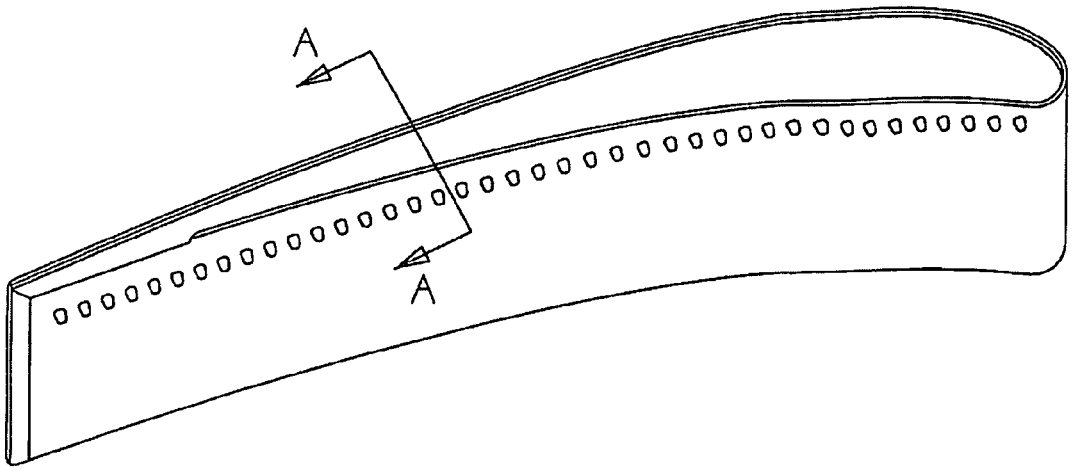
Fig 2 Prior art
FIG. 2 shows a profile view of the pressure side of the prior art blade tip of FIG. 1.
Figure 3:
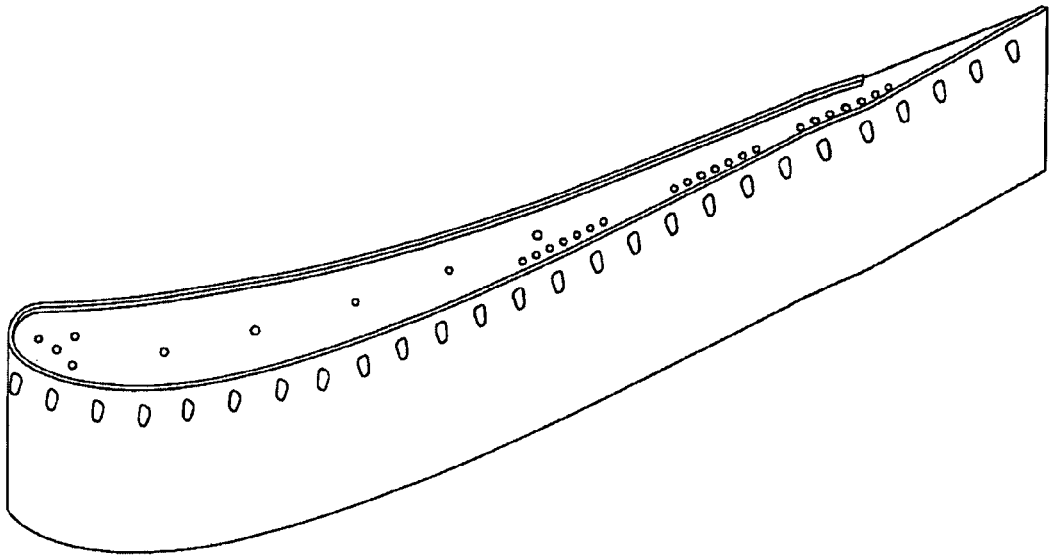
Fig 3 Prior Art
FIG. 3 shows a profile view of the suction side of the prior art blade tip of FIG. 1.
Figure 4:
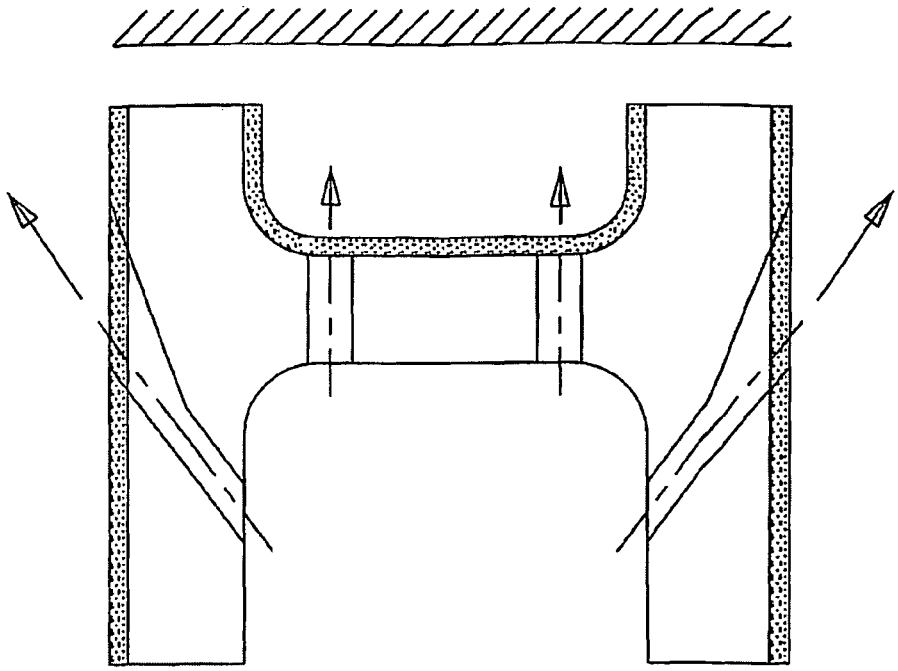
Fig 4 Prior Art
FIG. 4 shows a cross section view of the blade tip cooling design of the prior art.
Figure 5:
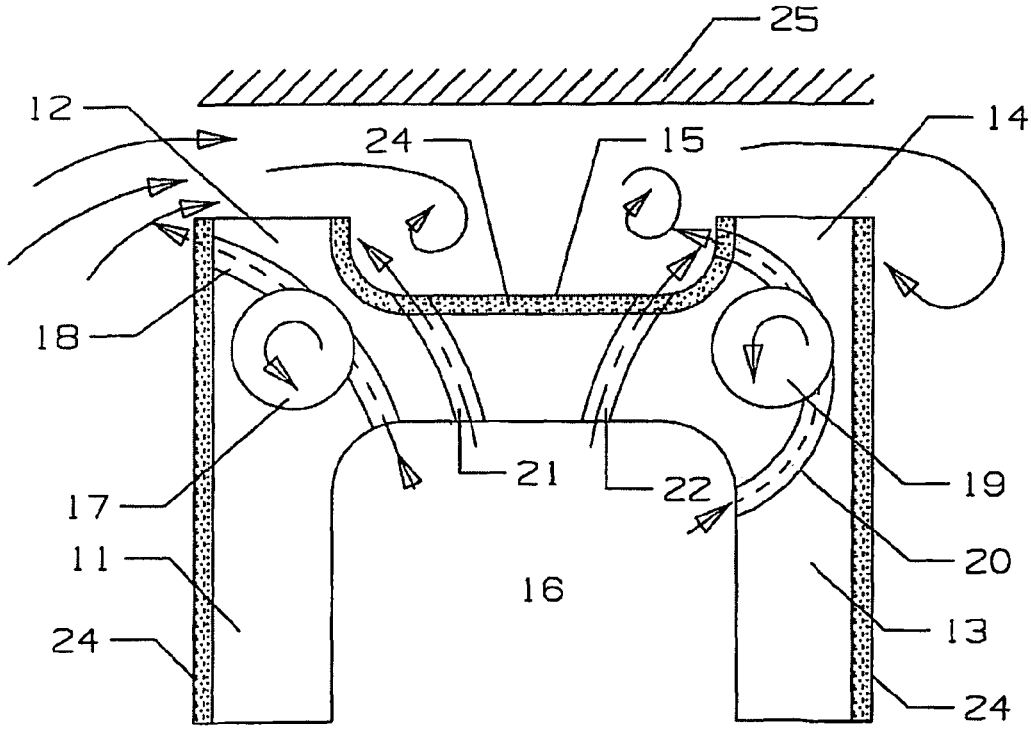
FIG. 5 shows a cross section view of the blade tip cooling design of the present invention.

The turbine blade with the tip cooling arrangement of the present invention is shown in FIG. 5 where the blade tip includes a pressure side wall 1 with a pressure side tip rail 12, a suction side wall 13 with a suction side tip rail 14, and a squealer pocket 15 formed between the two tip rails 12 and 14. the two tip rails 12 and 14 include flat tip crowns that form a seal with the blade outer air seal (or BOAS) 25 of the shroud of the engine. the two walls 11 and 13 also, form at least one cooling supply cavity 16 within the blade in which pressurized air is supplied to provide internal cooling for the blade. The cooling supply cavity 16 can be part of a serpentine flow cooling circuit or a single radial cooling channel formed within the blade.

Two vortex cooling channels are formed within the tip region, where a pressure side vortex cooling channel 17 extends along the pressure side tip rail region and a suction side vortex cooling channel 19 extends along the suction side tip rail. Both vortex cooling channels are arranged between the tip rail and the cooling supply cavity to provide cooling to the metal in this region. A pressure side wall curved cooling hole 18 connects the cooling supply cavity 16 to the pressure side wall surface of the blade just below the pressure side tip rail 12. the inlet of the curved cooling hole 18 opening into the vortex cooling channel 17 is offset from the outlet of the curved cooling channel opening onto the pressure side wall so that the cooling air flowing into the vortex cooling channel 17 will flow in a vortex path before discharging onto the airfoil wall. A row of these curved cooling holes 18 extends along the pressure side wall 11 where tip rail cooling is required.

On the suction side tip rail 14, a row of suction side curved cooling holes 20 is formed with each opening into the suction side vortex cooling channel that extends along the suction side tip rail region between the tip rail 14 and the cooling supply cavity 16. the inlets for the suction side curved cooling holes opening into the vortex cooling channel 19 are offset from the outlets that open into the pocket 15 in order to form a vortex flow within the vortex channel 19. The suction side curved cooling holes open onto the suction side tip rail 14 on the pocket side as seen in FIG. 5. the curved cooling holes 18 and 20 both curve toward the pressure side wall as opposed to the suction side wall as seen in FIG. 5.

Two rows of curved tip cooling holes 21 and 22 are also drilled into the tip floor and connect to the cooling supply cavity 16 and are curved toward the tip rails to produce a vortex flow around the inner sides of the tip rails as seen by the arrows in FIG. 5. The curved tip holes are directed to inject cooling air along the inner walls of the tip rails to produce this effect.

Cooling air is injected into the continuous vortex cooling channel from the blade cooling air supply cavity below at locations offset from the axis of the continuous vortex cooling channel to the inner wall of the vortex channel for the generation of a high strength vortex flow field within the vortex channel. This creates a high internal heat transfer capability for the cooling of the blade tip rail locations. This repeated process will achieve a high rate of heat transfer coefficient within the vortex cooling channel. Since the discrete cooling holes are in a curved shape, the cooling air is forced to change its momentum while flowing through the cooling holes which generates a high rate of internal heat transfer coefficient within the curved cooling holes. The spent cooling air can be discharged into the airfoil pressure side to provide additional film cooling and sealing, or discharged into the squealer pocket for sealing purposes.

For the pressure side and suction side discrete cooling holes positioned close to the airfoil peripheral tip walls, below the tip crown, the cooling flow is discharged in an opposite direction of the secondary flow over the blade tip from the pressure side wall to the suction side wall. The cooling air discharged from these holes will pinch the secondary flow and reduce the leakage flow through the blade tip to yield a lower leakage flow. A lower leakage flow results in a lower external heat load on the blade pressure and suction tip rails. This creates an effective method for cooling and sealing the blade tip rail which results in a reduction of the blade tip rail metal temperature.

In operation, due to the pressure gradient across the airfoil from the pressure side to the suction side, the secondary flow near the pressure side surface is migrated from the lower blade span upward across the blade end tip. The near wall secondary flow will follow the airfoil contour and flow upward while the discharged cooling air from the discrete cooling hole will flow against the on-coming streamwise leakage flow. This counter flow action reduces the on-coming leakage flow as well as pushes the leakage outward to the blade outer air seal. In addition to the counter flow action, this also forces the secondary flow to bend outward as the leakage enters the pressure side tip entrance corner and yields a smaller vena contractor, and thus reducing the effective leakage flow area. As the leakage flows through the blade pressure side tip rail, a small vortex is formed at the downstream location of the tip rail. The inner cooling hole will discharge cooling air in line with the vortex flow and provide additional reduction to the effective vena contractor flow area as well as provide higher heat transfer cooling performance for the inner corner of the blade tip rail. The end result for this combination of effects is to reduce the blade leakage flow that occurs at the blade pressure side tip location. As the leakage flows through the pressure side end tip, the squealer pocket in-between the airfoil pressure and suction side tip rail creates a flow recirculation with the leakage flow.

On the blade suction wall tip rail, the injection of cooling air also impacts on the leakage reduction. A similar cooling arrangement to the pressure side tip rail is utilized for the suction tip rail except that the curved cooling holes discharge cooling air into the inner fillet corner of the squealer pocket instead of on the suction side wall. The injection of cooling air into the fillet corner on the suction side tip rail will accelerate the secondary flow upward and flow against the on-coming leakage flow and push the leakage outward toward the blade outer air seal. Subsequently, this injection of cooling air will neck down the vena contractor and reduce the effective flow area. As a result of both cooling flow injections, the leakage flow across the blade end tip is further reduced. As the leakage flows through the suction wall end tip, a recirculation flow is generated by the leakage on the upper span blade of the suction side wall.

The creation of these leakage flow resistance by the blade end tip cooling geometry and cooling flow injection yields a very high resistance for the leakage flow path and thus reduces the blade leakage flow and heat load. With the creation of additional tip rail cooling by the vortex cooling channel and the discrete cooling holes results in a reduction of the blade tip section metal temperature.

I claim the following:

1. A turbine blade for use in a gas turbine engine, the blade comprising:

a pressure side wall with a pressure side tip rail;

a suction side wall with a suction side tip rail;

a squealer pocket formed by a tip floor and the pressure side tip rail and the suction side tip rail;

at least one cooling supply cavity formed within the blade;

a pressure side vortex cooling channel extending along the pressure side wall between the pressure side tip rail and the cooling supply cavity;

a suction side vortex cooling channel extending along the suction side wall between the suction side tip rail and the cooling supply cavity;

a pressure side cooling hole connecting the cooling supply cavity to the pressure side vortex cooling channel and opening onto the pressure side wall near to the pressure side tip rail;

a suction side cooling hole connecting the cooling supply cavity to the suction side vortex cooling channel and opening onto the squealer pocket side wall of the suction side tip rail; and, the inlets and the outlets of the pressure side cooling hole and suction side cooling hole are offset to produce a vortex flow within the vortex cooling channels.

2. The turbine blade of claim 1, and further comprising:

the pressure side cooling hole and the suction side cooling hole are both curved cooling holes which curved toward the pressure side wall.

3. The turbine blade of claim 1, and further comprising:

a first tip cooling hole connecting the cooling supply cavity to the tip floor and opening adjacent to the inner surface of the pressure side tip rail; and, a second tip cooling hole connecting the cooling supply cavity to the tip floor and opening adjacent to the inner surface of the suction side tip rail.

4. The turbine blade of claim 3, and further comprising:

the first tip cooling hole is curved toward the pressure side wall; and, the second tip cooling hole is curved toward the suction side wall.

5. The turbine blade of claim 3, and further comprising:

the first and second tip cooling holes are directed to discharge cooling air to form a vortex flow against the inner sides of the tip rails.

6. The turbine blade of claim 1, and further comprising:

a row of pressure side cooling holes extending along the pressure side of the blade, each of the pressure side cooling holes being connected to the pressure side vortex channel; and, a row of suction side cooling holes extending along the inner side of the suction tip rail, each of the suction side cooling holes being connected to the suction side vortex channel.

7. The turbine blade of claim 1, and further comprising:

the pressure side cooling hole opens onto the pressure side wall at a direction of around 20 degrees normal to the wall at upward toward the tip crown.

* * * * *